US007206010B2

(12) United States Patent
Maghakian

(10) Patent No.: US 7,206,010 B2
(45) Date of Patent: Apr. 17, 2007

(54) SYSTEMS AND METHODS FOR PROVIDING A MEDIA LOCATED ON A SPOOL AND/OR A CARTRIDGE WHERE THE MEDIA INCLUDES A WIRELESS COMMUNICATION DEVICE ATTACHED THERETO

(75) Inventor: Emil Maghakian, Thousand Oaks, CA (US)

(73) Assignee: ZIH Corp., Hamilton (BM)

( * ) Notice: Subject to any disclaimer, the term of this patent is extended or adjusted under 35 U.S.C. 154(b) by 280 days.

(21) Appl. No.: 10/826,765

(22) Filed: Apr. 16, 2004

(65) Prior Publication Data

US 2005/0231583 A1 Oct. 20, 2005

(51) Int. Cl.
*B41J 32/00* (2006.01)

(52) U.S. Cl. ..... 347/214

(58) Field of Classification Search ..... None
See application file for complete search history.

(56) References Cited

U.S. PATENT DOCUMENTS

| | | | |
|---|---|---|---|
| 4,031,518 | A | 6/1977 | Holloran et al. |
| 4,710,781 | A | 12/1987 | Stephenson |
| 4,797,018 | A | 1/1989 | Hofmann et al. |
| 4,806,958 | A | 2/1989 | Momot et al. |
| 4,845,490 | A | 7/1989 | Ward et al. |
| 4,970,531 | A | 11/1990 | Shimizu et al. |
| 5,138,344 | A | 8/1992 | Ujita |
| 5,149,211 | A | 9/1992 | Pettigrew et al. |
| 5,266,968 | A | 11/1993 | Stephenson |
| 5,267,800 | A | 12/1993 | Petteruti et al. |
| 5,318,370 | A | 6/1994 | Nehowig |
| 5,455,617 | A | 10/1995 | Stephenson et al. |
| 5,703,347 | A | 12/1997 | Reddersen et al. |
| 5,707,162 | A | 1/1998 | Kasai et al. |
| 5,755,519 | A | 5/1998 | Klinefelter |
| 5,768,633 | A | 6/1998 | Allen et al. |
| 5,995,768 | A | 11/1999 | Kitagawa et al. |
| 6,011,741 | A | 1/2000 | Wallace et al. |
| 6,037,879 | A | 3/2000 | Tuttle |
| 6,039,430 | A | 3/2000 | Helterline et al. |
| 6,071,024 | A | 6/2000 | Chi-Ming et al. |
| 6,072,402 | A | 6/2000 | Kniffin et al. |

(Continued)

FOREIGN PATENT DOCUMENTS

| | | |
|---|---|---|
| EP | 0 592 979 A2 | 9/1993 |

(Continued)

*Primary Examiner*—K. Feggins
(74) *Attorney, Agent, or Firm*—Alston & Bird LLP

(57) ABSTRACT

A media supply apparatus and associated methods are provided. The apparatus can include a spool on which a media is wound, and/or the media can be provided in a cartridge either wound about a spool or wound about itself. A wireless device such as a programmable radio frequency identification (RFID) device is disposed on the media, for example, near one of the ends of the media. The wireless device can have a memory that is configured to store data and an antenna configured to receive a radio frequency signal for programming the memory. Thus, the wireless device can be used to store data associated with the supply apparatus such as the type of media, aspects of the manufacture of the media, and the like. In some cases, the data can be programmed before or during use of the supply apparatus.

23 Claims, 11 Drawing Sheets

U.S. PATENT DOCUMENTS

| | | | | |
|---|---|---|---|---|
| 6,099,178 | A | 8/2000 | Spurr et al. | |
| 6,173,119 | B1 | 1/2001 | Manico et al. | |
| 6,213,392 | B1 | 4/2001 | Zuppicich | |
| 6,227,643 | B1 * | 5/2001 | Purcell et al. | 347/19 |
| 6,252,791 | B1 | 6/2001 | Wallace et al. | |
| 6,386,772 | B1 | 5/2002 | Klinefelter et al. | |
| 6,593,952 | B1 * | 7/2003 | Funayama et al. | 347/193 |
| 6,824,320 | B1 | 11/2004 | Kerr et al. | |
| 2001/0007458 | A1 * | 7/2001 | Purcell et al. | 347/19 |
| 2002/0170973 | A1 | 11/2002 | Teraura | |
| 2002/0191998 | A1 * | 12/2002 | Cremon et al. | 400/76 |

FOREIGN PATENT DOCUMENTS

| | | |
|---|---|---|
| EP | 0 887 197 A2 | 6/1998 |
| EP | 0 979 736 A1 | 2/2000 |
| WO | WO 99/49379 | 9/1999 |

* cited by examiner

SYSTEMS AND METHODS FOR PROVIDING A MEDIA LOCATED ON A SPOOL AND/OR A CARTRIDGE WHERE THE MEDIA INCLUDES A WIRELESS COMMUNICATION DEVICE ATTACHED THERETO

BACKGROUND OF THE INVENTION

1) Field of the Invention

This invention relates to a media for placement on a spool and/or in a cartridge having a wireless device disposed on the media for providing information concerning the media, such as a media wound on a spool with a radio frequency identification device disposed on the media.

2) Description of Related Art

Wireless devices, such as radio frequency identification (RFID) devices have revolutionized the industry of information tracking. These devices can be placed on an item, and information concerning the item can be stored in the device. The item can thus be tracked and monitored during shipment, storage, etc. The wireless device can also be used to store information about the item during its use. For example, if the item is a consumable, information concerning the amount used of the item or the amount remaining could be stored on the device associated with the item.

An RFID device is a typical wireless device used for item tracking and information. An RFID device includes an RFID circuit that generally comprises a processor, a memory, and an antenna. The antenna is configured to receive a radio frequency (RF) signal and provide the signal to the processor of the RFID circuit device and, in the case of a passive device, energize the RFID circuit device for operation of the device. Thus, a transceiver such as a read/write head can be used to transmit an RF signal to the RFID device to power the RFID circuit device and communicate with the RFID device. For example, data can be preprogrammed in the memory of the RFID device or communicated to the memory by the transceiver. In either case, the transceiver can also generate a signal for retrieving the data from the device. RFID devices can also include an energy source in the device for powering the RFID circuit. These are typically referred to as active RFID devices.

As mentioned, wireless devices are used in a variety of applications for storing and communicating data, such as in devices for tracking the movement of goods during manufacture, automobile immobilizer devices, and electronic freeway toll passes. In the electronic printing industry, wireless devices, such as RFID devices, can be provided in a printing cartridge or on a spool and used to store information about the media contained therein, such as the lot or serial number, the date of manufacture of the media, the type or dye color(s) of the media, and the like. In some cases, the RFID device can also be used to store information relating to the use of the media contained in the cartridge or on the spool. For example, a counter can be programmed in the memory of the RFID device and decremented as portions of the media are used so that the counter always reflects the amount of media remaining. The printer that uses the cartridge or spool can include a read/write head or other transceiver that is configured to communicate with the RFID device so that the printer receives the data stored in the device. The data can be used to automatically recognize the media and automatically determine operational characteristics of the media. For example, the transceiver in the printer can automatically decrement the counter in the RFID device so that the counter reflects the remaining use of the media. When the remaining use is low, the printer can signal an operator. The use of such RFID devices in printing devices is further described, e.g., in U.S. Pat. No. 6,386,772 to Klinefelter, et al. and U.S. Pat. No. 5,455,617 to Stephenson, et al.

An RFID device for a conventional printing media, such as a ribbon, is typically located proximate to the read/write head or other transceiver so that proper communication can be achieved between the transceiver and the device. In addition, the device can be mounted on the spool or disposed on the cartridge in a position so that the RFID device is located out of the way of other moving members to avoid damage to the RFID device. However, the location of the RFID device can limit the flexibility of the design and manufacture of the ribbon and cartridge and/or spool. For example, if the device is to be mounted on the spool, it may be necessary to manufacture the spool and mount the RFID device therein before winding the ribbon on the spool. Further, if the device is disposed in either of the spool or the cartridge, the RFID device is associated with the ribbon only after both the ribbon and cartridge are manufactured and assembled with the ribbon. Thus, the spool or cartridge with the device may be subject to different manufacturing conditions than the ribbon. In addition, the device generally cannot be used to store data regarding the ribbon until after the ribbon is manufactured and assembled with the spool or cartridge.

While RFID devices in conventional media supply devices have proven effective for data storage, there exists a continued need for improved devices and methods for data storage and communication. In particular, there is a need for an improved device and method for associating a wireless device with a variety of materials such as printing ribbon, film, paper, and the like. The improved device and method should allow the wireless device to be associated directly with the media such that the wireless device does not need to be assembled with a spool, cartridge, or other support structure before association or assembly with the media.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate preferred and exemplary embodiments, but which are not necessarily drawn to scale, wherein.

DETAILED DESCRIPTION OF THE INVENTION

Figure 1:
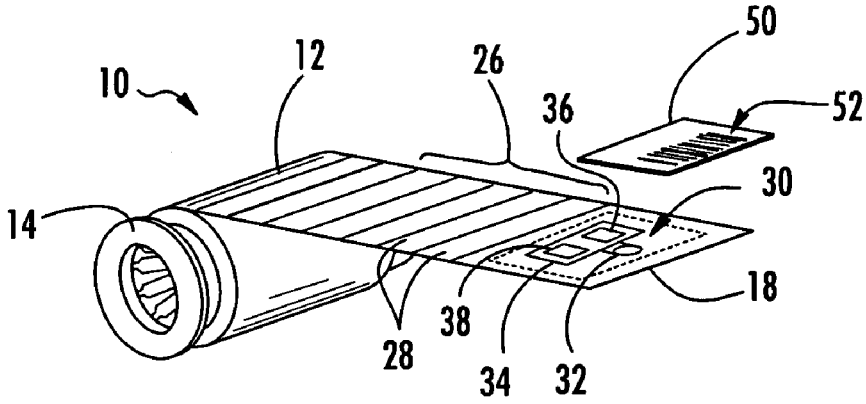
FIG. 1 is a perspective view illustrating a media supply apparatus configured to supply a media in the form of a transfer ribbon according to one embodiment of the present invention, shown with an overlay removed from the media for illustrative clarity.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

One embodiment provides a media supply apparatus and an associated method. The media may be any material that is located on a spool or in a cartridge and metered therefrom during use. For example, the media could be printing ribbon, paper, tape, wire, or essentially any other material located on a spool and/or in a cartridge. The apparatus includes a wireless device that is disposed on the media such that the device can be associated directly with the media and at various stages of manufacture as desired. In some cases, the wireless device can be associated with the media even before the media is wound onto a spool and/or placed in a cartridge that supports the media during use. The wireless device can be of any type. In some embodiments, the device is one or more of a frequency reception device, such as an RFID device, an optical device, such as a device containing an optical transceiver, a magnetic sensing device, such as device containing a Hall effect sensor, capacitive sensor, etc., or any other type of wireless device. According to one embodiment of the present invention, the media supply apparatus includes a spool and a media at least partially wound thereon. For example, the media can be a transfer ribbon such as a dye carrier with at least one thermal transfer dye disposed thereon.

A wireless device is disposed on the media. In this embodiment, the wireless device has a memory configured to store data and a transceiver capable of receiving signals to either program the device and/or transmit wirelessly data stored in the device. For example, where the wireless programmable device is an RFID device, the device can include an antenna configured to receive a radio frequency signal for programming the memory and transmitting information stored in the device wirelessly. The wireless device can be placed anywhere on the media. In some embodiments, the wireless device can be disposed proximate to the distal ends of the media. For example, the media can be wound on the spool so that a first end is disposed radially inward of a plurality of wound layers of the media and a second end is disposed radially outward of the plurality of wound layers, with the wireless device being disposed at either end.

The wireless device can be programmed with data corresponding to a characteristic of the media such as the length of the media, a print agent on the media, or a location of a defect on the media, the lot number of the media, the location where the media was manufactured, etc. In one embodiment, the memory of the wireless device stores a counter that can be decremented so that the counter corresponds to the amount of the media remaining.

According to one aspect of the invention, the spool is disposed in the interior space of a housing or cartridge, and the wireless device is configured to receive a wireless signal transmitted through the housing.

The present invention also provides a method of manufacturing a supply apparatus. The method includes winding a media onto a spool or into a cartridge and disposing a wireless device on the media. For example, the media can be a laminar dye carrier with thermal transfer dye, paper, or a laminate film. The wireless device can be disposed anywhere on the media. In some embodiments, the device is placed at either end of the media so that the device is between the spool and the layers of media wound on the spool or opposite the wound layers from the spool. A memory of the wireless device is programmed with data, which is then retrieved from the memory.

According to one aspect of the invention, the data is retrieved by transmitting a polling signal to the wireless device so that the device communicates data stored in the device to the reader or transceiver. The wireless device can also be reprogrammed by transmitting a polling signal to the device. For example, a counter in the memory of the wireless device can be decremented during use of the media so that the counter corresponds to the amount of the media remaining on the spool. In this instance, the counter is originally programmed with a number of counts representing the total amount of the media. As the media is metered from the spool and/or cartridge, the counter of the wireless device is decremented.

The wireless device can be any device that allows for wireless communication. The device could be an RFID device, an optical device, a capacitance or conductive sense device, a device that incorporates Wi-Fi, Bluetooth, etc., a memory can such as is provided by Dallas Semiconductor and referred to as "Memory Button" part series 199x, a memory can provided by EDS, an electronic article surveillance (ESA) RF resonant security element or the like.

Further, the wireless device may be attached to the media in any manner. For example, the wireless device may be attached on a surface of the media with an adhesive or overlaid with a laminate. In some embodiments, the media is multi-ply. In these embodiments, the wireless device may be embedded between two plies of the media. Further, the wireless device may be assembled on the media. For example, if the wireless device is an RFID device, the antenna for the device could be applied to the media via printing, deposition, etc. The RFID chip could then be attached to the antenna, and an overlay laminated over the device.

The wireless device may be placed any where on the media either an edge surface or a top or bottom surface. Further, the wireless device can be placed at either end of the media or at any points in between the ends. For example, the wireless device may be placed on the end of the media near the take-up spool, so that the wireless device is visible prior to installation. In other embodiments, the wireless device may be placed on the end near the supply roll or at a midpoint between the two ends, such that it is wrapped about the spool and hidden from view when the spool is initially installed.

In some embodiments, the wireless device may be of sufficient thickness that it may disrupt the winding of the media about the spools. To remedy this problem, one or more of the spools may include a cavity, detent, groove, or other recess for receiving the wireless device when the media is wrapped about the spool. For example, if the wireless device is placed near one end of the media, the spool connected to that end of the media may include a groove or detent for receiving the wireless device when the media is wound onto the spool.

Provided below are various examples embodiments of the present invention. These embodiments should in no way be considered as limiting the invention. The invention relates placement of a wireless device on any media wound on a spool or placed in a cartridge. The embodiments provided herein are mere examples of some of the applications of the invention.

Referring to FIG. 1, there is shown an apparatus 10 according to one embodiment of the present invention. The apparatus 10 is configured to contain a media material 12. As shown in FIG. 1, the apparatus 10 can include a spool 14 or core upon which the media 12 is wound. That is, the media 12 can be wound or coiled on the spool 14 so that a first end (not shown) of the media 12 is disposed against the spool 14 and successive layers of the media 12 are wound thereon. Thus, the spool 14 is configured so that a second end 18 of the media 12 can be dispensed from the spool 14 as the spool 14 rotates. Alternatively, the media 12 can be provided in the wound configuration, without the spool 14, such as being wound and placed in a cartridge.

Figure 2:
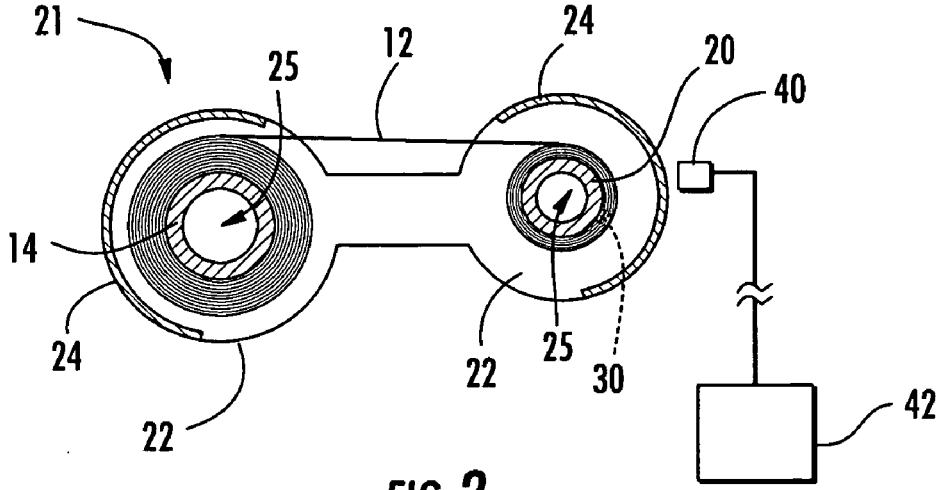
FIG. 2 is a section view in elevation illustrating a media supply apparatus in a cartridge according to another embodiment of the present invention.

The spool 14 (or the central portion of the wound media 12, if no spool is used) can be hollow so that a shaft can be disposed therethrough to support the media 12 as the media 12 is rotated. Alternatively, the spool 14 can be solid and can define connection features for rotatably mounting the apparatus 10. In any case, the spool 14 can be used in conjunction with other spools or devices that receive the media material. For example, as shown in FIG. 2, the spool 14 is configured to supply the media 12, which is then wound onto a take-up spool 20 so that a constant length of the media 12 is provided between the two spools 14, 20. In the embodiment of FIG. 2, both spools 14, 20 and the media 12 are an integral part of a cartridge 21 for supplying the media 12. That is, the cartridge 21 includes a housing 22 or other structure for supporting the spools 14, 20. The housing 22 can include two parallel sidewalls 23 that are connected by curved walls 24 extending between the sidewalls 23. The sidewalls 23 define holes 25 for receiving the spools 14, 20, so that the spools 14, 20 are supported between the sidewalls 23 in an interior space defined between the walls 23, 24. The cartridge 21 can be installed as a single unit into a thermal dye printer or other device according to the intended use of the media 12.

The media 12 can be any of various types of media materials that are used for assorted applications. The media can be printer ribbon, paper, labels, magnetic media, wire, fabric, plastics, etc. In other words, any material that is would on a spool or placed in a cartridge. In some embodiments, the media 12 is a sheet of paper, plastic, or other laminar material that can be wound onto the spool 14 and/or unwound from the spool 14 as the media 12 is being printed, coated, cut, dried, or otherwise processed or used. For example, the media 12 can be a film such as photographic film, lamination material, and the like.

A wireless device 30 is disposed on the media 12 and is configured to receive, transmit, and/or store data. For example, the wireless device 30 can be an RFID device, an optical device, a capacitance or conductive sense device, a device that incorporates Wi-Fi, Bluetooth, etc., a memory can such as is provided by Dallas Semiconductor and referred to as "Memory Button" part series 199x, a memory can provided by EDS, an electronic article surveillance (ESA) RF resonant security element or the like. As schematically illustrated in FIG. 1, the wireless device 30 is an RFID device that includes an antenna 32 that is electrically connected to a circuit 34, which is typically provided as an integrated circuit on a chip. The circuit 34 includes a memory 36 and a transceiver circuit 38. The transceiver circuit 38 can be configured to communicate with the antenna 32 so that data can be received via a radio frequency signal that is received by the antenna 32 and processed by the transceiver circuit 38. The transceiver circuit 38 can also communicate with the memory 36 so that data received by the transceiver circuit 38 can be stored in the memory 36. Similarly, data from the memory 36 can be retrieved by the transceiver circuit 38 to be processed, reprogrammed, and/or transmitted as a radio signal via the antenna 32. In other embodiments of the present invention, the wireless device 30 and a read/write head 40 can be configured to communicate via other electromagnetic or magnetic signals. For example, each of the read/write head 40 and the wireless device 30 can be configured to transmit and/or receive optical signals or magnetic signals. In particular, the wireless device 30 can be an optical device, such as a device containing an optical transceiver, or a magnetic sensing device, such as device containing a Hall effect sensor, capacitive sensor, and the like.

The wireless device 30 can include other components, such as additional data processing devices, electronic indicators, a temperature sensor, and the like. The wireless device 30 can also include a power source, such as a battery for powering the circuit. Alternatively, the device 30 can be powered by an RF signal. That is, the transmission of a particular RF signal to the identification device 30 can energize particular portions of the device 30, e.g., to power the device 30 so that the device 30 transmits data from the memory 36 via the antenna 32.

Figure 9:
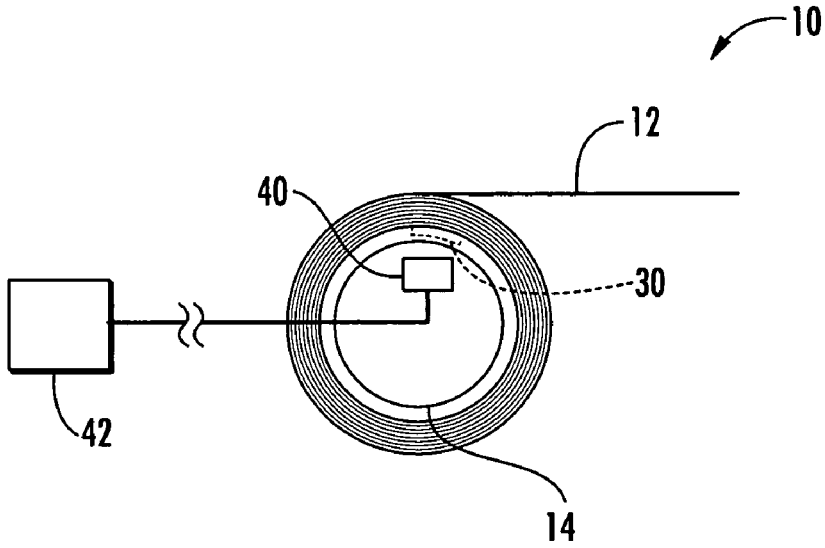
FIG. 9 is an elevation view illustrating the media supply apparatus of FIG. 8, shown with a transceiver configured to communicate with the wireless device.

A transceiver such as the read/write head 40 can be positioned proximate to the supply apparatus 10 and configured to generate an RF signal for communicating with the wireless device 30. For example, as shown in FIG. 1, the wireless device 30 can be disposed on one side of the media 12 and near the end 18 of the media 12 that extends from the wound supply apparatus 10. If the supply apparatus 10 is used in a cartridge, such as the cartridge 21 of FIG. 2, so that the end 18 of the media 12 is wound onto the take-up roll 20, the read-write head 40 can be positioned proximate to the take-up roll 20. Thus, the read/write head 40 can communicate with the identification device 30 through the layers of the media that are wound onto the take-up spool 20 overlapping the identification device 30. In some cases, the read/write head 40 can also communicate with the device 30 through the housing 24 of the cartridge 22, i.e., though the material of the walls 23, 24 or through an aperture in the walls 23, 24, or through one of the spools 14, 20 (FIG. 9).

Figure 3:
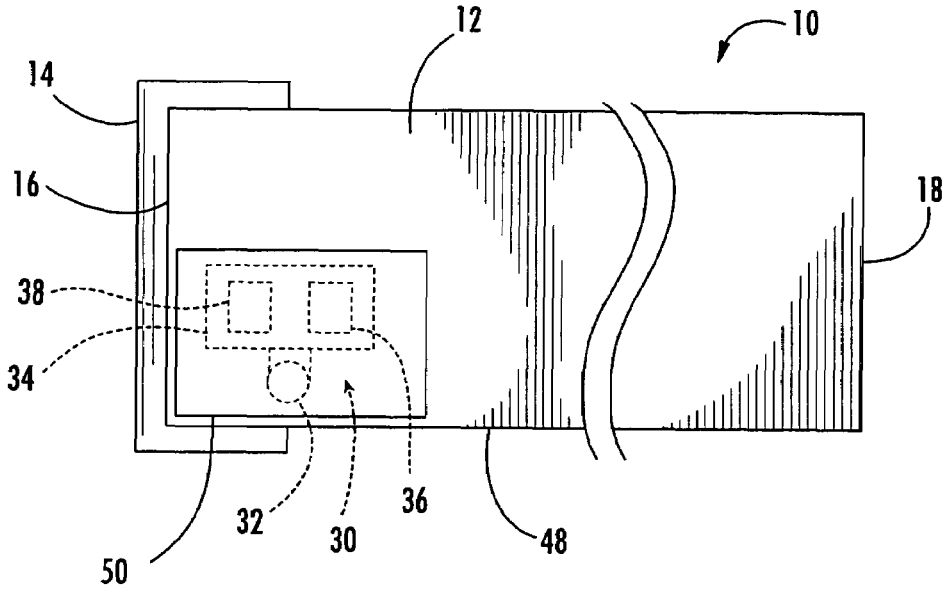
FIG. 3 is a plan view illustrating a media supply apparatus according to yet another embodiment of the present invention, shown before the media has been wound onto the spool.
Figure 4:
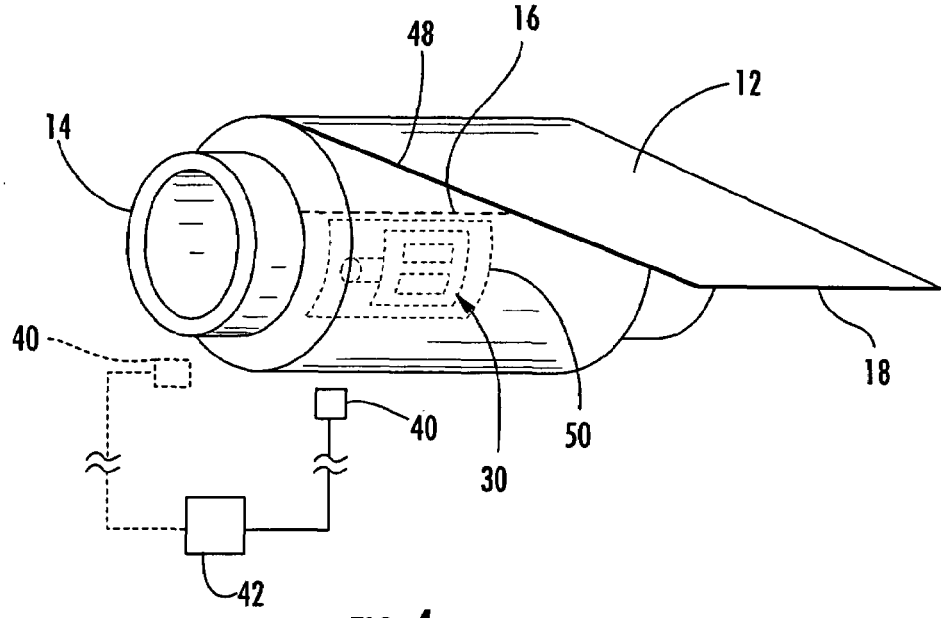
FIG. 4 is a perspective view of the media supply apparatus of FIG. 3 with the media wound on the spool.

Alternatively, the wireless device 30 can be disposed near the opposite end 16 of the media 12, proximate to the spool 14 so that the layers of media wound onto the spool 14 overlap the wireless device 30. FIG. 3 illustrates a supply apparatus 10 for providing a media 12 in which the wireless device 30 is disposed at the end 16 of the media 12 near the spool 14 and proximate to a transverse side 48 of the media 12. When the media 12 has been wound onto the spool 14, as shown in FIG. 4, the device 30 is positioned between the spool 14 and a plurality of layers of the media 12 that are wound thereon. The read-write head 40 can be positioned proximate to the spool 12, e.g., radially outward from the device 30, similar to the configuration illustrated in FIG. 2. Alternatively, as shown in dashed lines in FIG. 4, the read/write head 40 can be positioned adjacent the transverse side 48 of the media 12 and configured to communicate in the axial direction of the spool 14 toward the identification device 30.

The device 30 can be fixedly disposed on the media 12, e.g., by embedding, crimping, gluing, or otherwise adhering the device 30 to the media 12. The wireless device may be assembled on the media. For example, where the wireless device is an RFID device or the like, the antenna may be printed, deposited, etc. onto the media and the RFID chip applied thereto. A laminate may then overlay the chip and antenna. In some cases, an overlay 50 of material can be disposed on the device 30 so that the device 30 is disposed between the media 12 and the overlay 50. For example, the overlay 50 can be a label or sticker with an adhesive directed toward the media 12 so that the overlay 50 adheres to the media 12, thereby maintaining the position of the device 30 on the media and/or and protecting the device 30. The overlay 50 can be formed of a thin sheet of paper or polymer, and the overlay 50 can be printed with information such as a barcode 52 (FIG. 1) or other symbols relating to the type or manufacture of the supply apparatus 10 or portions thereof. In combination, the overlay 50 and the device 30 can comprise a "smart label," i.e., an adhesive label embedded with a thin wireless device inlay, which includes the circuit 34 and a printed antenna 32.

Figure 5A:
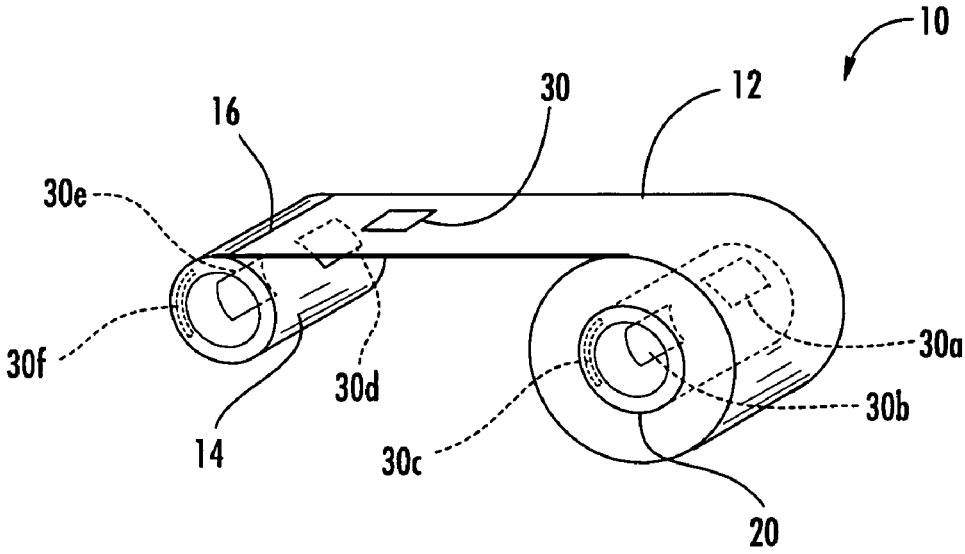
FIGS. 5A–5C are perspective views illustrating media supply apparatuses configured to supply a media according to three embodiments of the present invention in which the wireless device is disposed proximate to an end of the media near a supply spool, proximate to an end of the media near a take-up spool, and between the ends of the media, respectively.
Figure 5B:
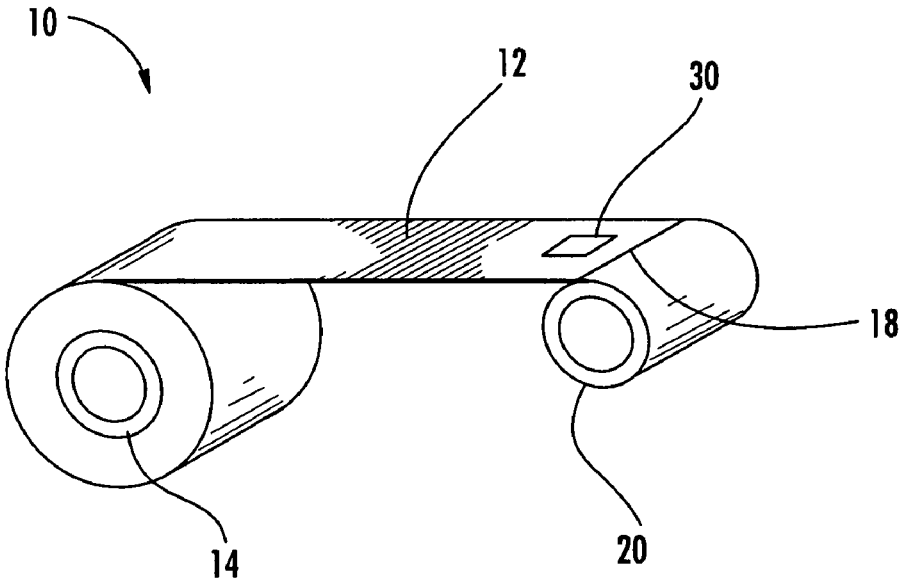
Figure 5C:
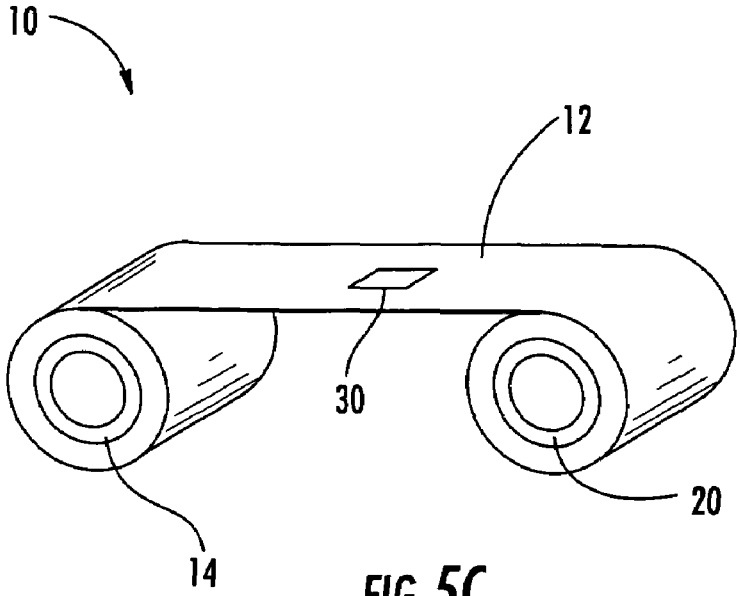

FIGS. 5A–5G illustrate various example embodiments of the invention. For example, FIG. 5A illustrates an embodiment where the media 12 has opposed ends, where one end is connected to a supply spool and the opposed end is connected to a take-up spool. When initially manufactured, the media is wound about the supply spool 14, and during use is wound on the take-up spool 20. In FIG. 5A, the wireless device 30 is located on the media 12 proximate to the take-up spool 20. In FIG. 5B, the wireless device 30 is located on the media 12 proximate to the supply spool 14, and in FIG. 5C, the wireless device is located on the media 12 at a location somewhere between the opposed ends. Note here that even though the wireless device is illustrated as being centered within the width of the media, that this is not a requirement.

Figure 5D:
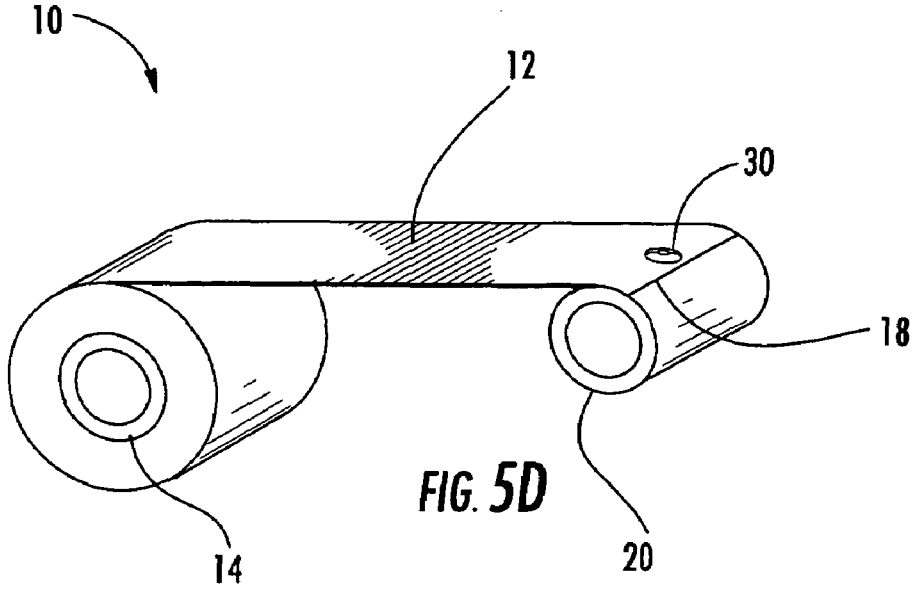
FIG. 5D–5F are perspective views illustrating media supply apparatuses according to three embodiments of the present invention in which the wireless device of each apparatus is, respectively, an optical device, a conductive can or button, and a magnetic or capacitive strip.
Figure 5E:
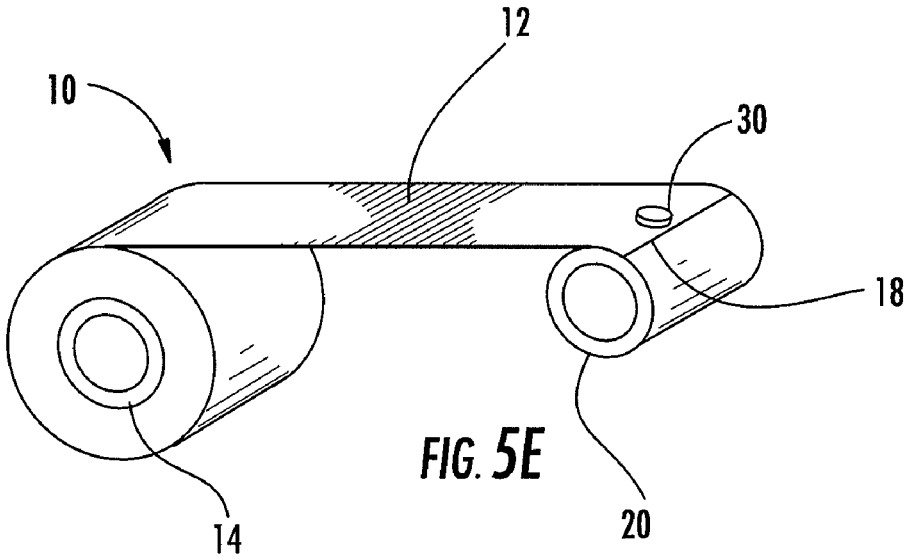
Figure 5F:
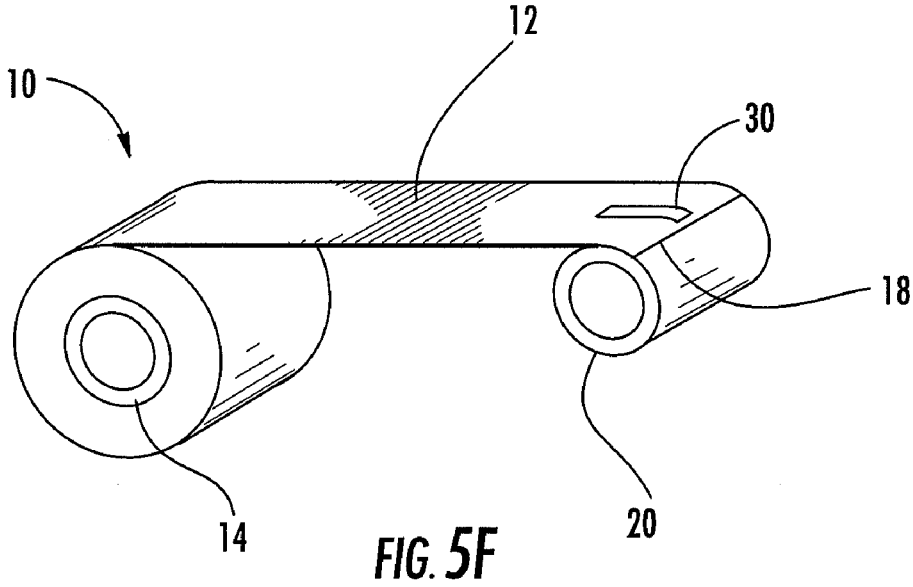
Figure 5G:
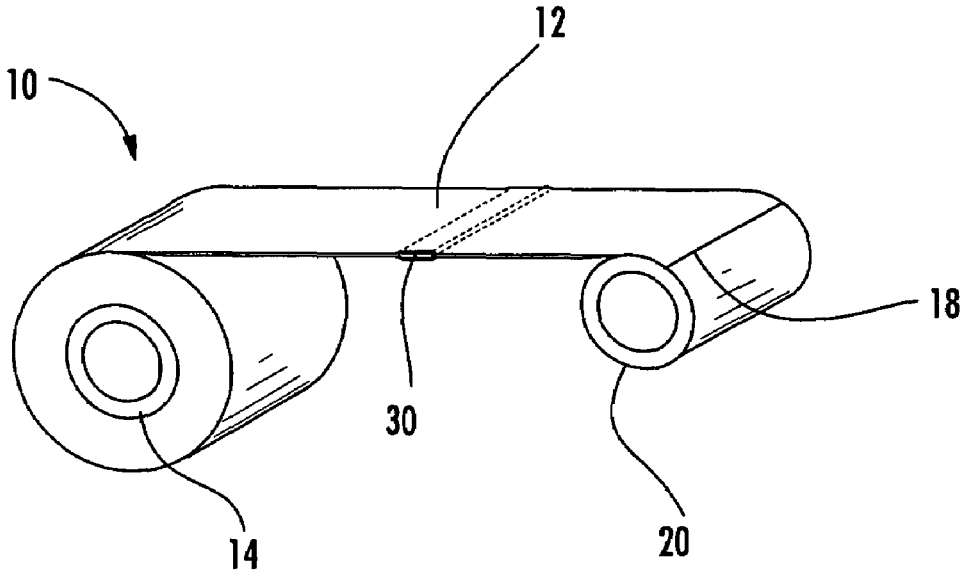
FIG. 5G is a perspective view illustrating a media supply apparatus according to another embodiment of the present invention in which the wireless device is disposed between layers of the media.

FIG. 5D illustrates the wireless device 30 as an optical device. In this embodiment, the optical device is placed on the end of the media next to the take-up spool such that it can be read during installation of the spool. FIG. 5E discloses a conductive can or button applied to the media, while FIG. 5F discloses a magnetic or capacitive strip attached to the media. FIG. 5G illustrates an embodiment where the media is multi-plied, and the wireless device is sandwiched between the plies.

The wireless device 30 can also be disposed on other portions of the supply apparatus 10, e.g., at various positions on the spools or on the housing 24 or other portion of the cartridge 22 if so provided. For example, as illustrated in FIG. 5A, reference numerals 30*a*–30*f* illustrate possible positions for the wireless device 30. In particular, the wireless device 30 can be disposed on the outer surfaces of the spools 14, 20 as indicated by positions 30*a* or 30*d*, on the inner surfaces of the spools 14, 20 as indicated by positions 30*b* and 30*e*, or at the axial ends of the spools 14 as indicated by positions 30*bc* and 30*f*. Further, in some cases, multiple wireless devices 30 can be provided at different positions, such as any of the positions 30*a*–30*f*. In one embodiment, the wireless devices 30 are located on the media 12 as well as on one or both of the spools 14, 20. In another embodiment, the wireless devices 30 are located at multiple positions on the media 12, at multiple positions on a single one of the spools 14, 20, or on both of the spools 14, 20.

The wireless devices 30 can be configured for communicating with different read/write heads 40 or at different times depending on the location or orientation of the apparatus 10. For example, one wireless device 30 can be disposed on the spool 14, e.g., in positions 30*a*, 30*b*, or 30*c*, and configured to communicate with a read/write head proximate to the spool 14. Similarly, another wireless device 30 can be disposed on the take-up spool 20, e.g., in positions 30*d*, 30*e*, or 30*f*, and configured to communicate with a read/write head proximate to the spool 20. Alternatively, two wireless devices 30 can be provided on the spool 14, e.g., at any of positions 30*a*, 30*b*, and 30*c*, and configured to communicate with two read/write heads proximate to the spool 14. In another embodiment, one of the wireless devices 30 can be configured to communicate with the read/write head 40 while the apparatus 10 is disposed for use in a printer or other device, while the other wireless device 30 is configured to communicate with a read/write head when the apparatus 10 is otherwise positioned, e.g., when the apparatus 10 is outside of the printer or other device. In any case, the data stored in the different wireless devices can be the same, or different data can be stored according to the time or position of the apparatus at which data from each wireless device 30 is to be accessed. For example, data relevant to the operation of the apparatus 10 can be stored in a first wireless device 30 that is configured to be read during operation of the apparatus 10 or as the apparatus 10 is loaded or unloaded relative to the printer or other device for use. Data relevant to the manufacture or storage of the apparatus 10 can be stored in a second wireless device 30 that is configured to be read during manufacture or storage of the apparatus 10.

In some embodiments where multiple wireless devices 30 are provided on the apparatus, each wireless device 30 can be appropriately shielded from the other wireless device(s) 30 so that one or more of the read/write heads 40 can selectively communicated with each of the wireless devices 30. The shielding between the wireless devices 30 can be provided by the structure of the apparatus 10, such as by the plastic or other material of the spools 14, 20, or additional shielding material can be provided between the wireless devices 30. For example, an electromagnetic shielding material, such as a metallic film or structure, can be disposed between the wireless devices 30. In this regard, if wireless devices are provided at both positions 30*a* and 30*b*, a shielding material can be disposed therebetween so that read/write heads can be positioned radially inside and outside the spool 14 and configured to communicate with a single one of the devices 30. In other cases, the wireless devices 30 can be positioned with a sufficient space therebetween to allow the read/write heads 40 to selectively communicate with the devices 30. For example, one wireless device 30 can be disposed on each of the two spools 14, 20, and the read/write heads 40 can be positioned at corresponding positions, i.e., with one read/write head 40 being proximate to each of the spools 14, 20.

Figure 6A:
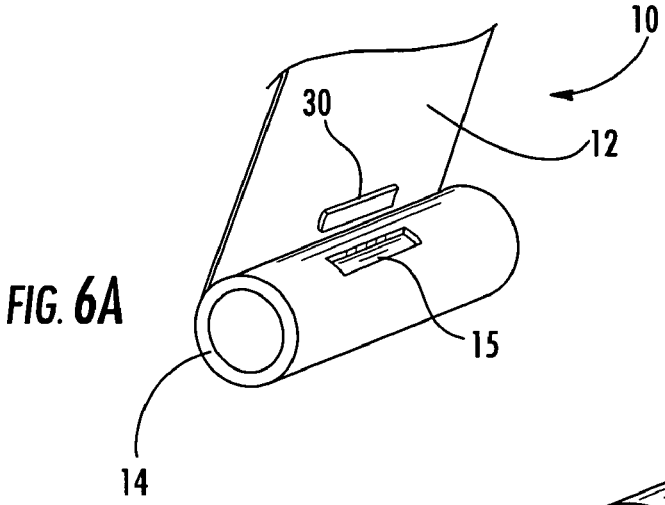
FIG. 6A is a perspective view illustrating a media supply apparatus according to yet another embodiment in which the spool is configured to at least partially receive the wireless device, the apparatus shown in an unwound configuration.
Figure 6B:
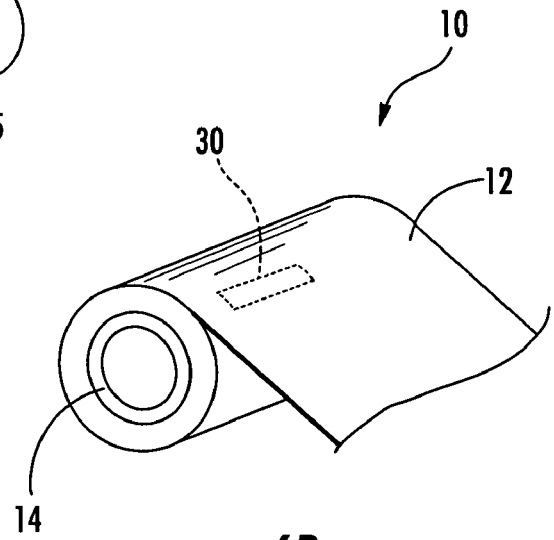
FIG. 6B is a perspective view of the media supply apparatus of FIG. 6A shown with the apparatus in a partially wound configuration.
Figure 7A:
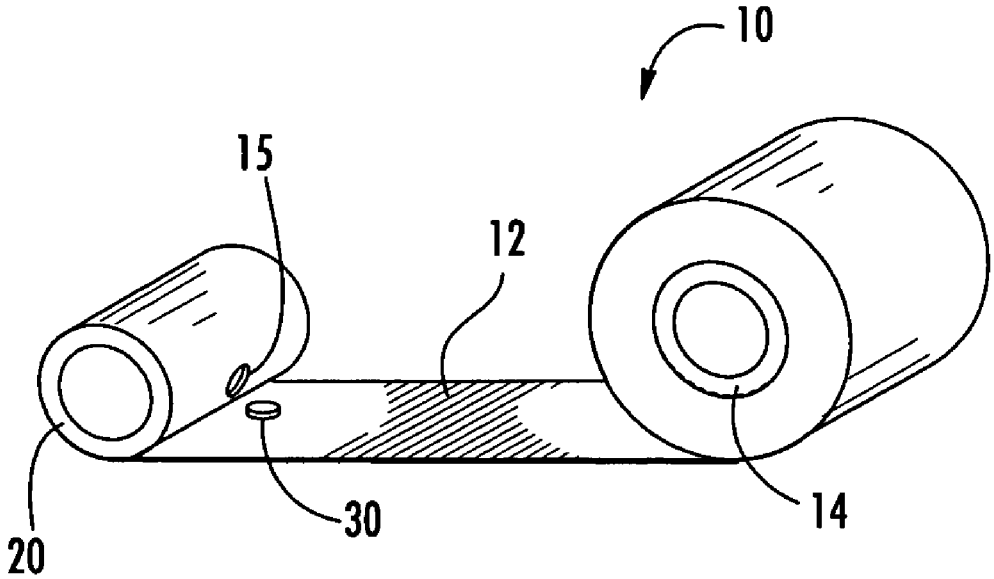
FIG. 7A is a perspective view illustrating a media supply apparatus according to still another embodiment in which the spool is configured to at least partially receive the wireless device, the apparatus shown in an unwound configuration.
Figure 7B:
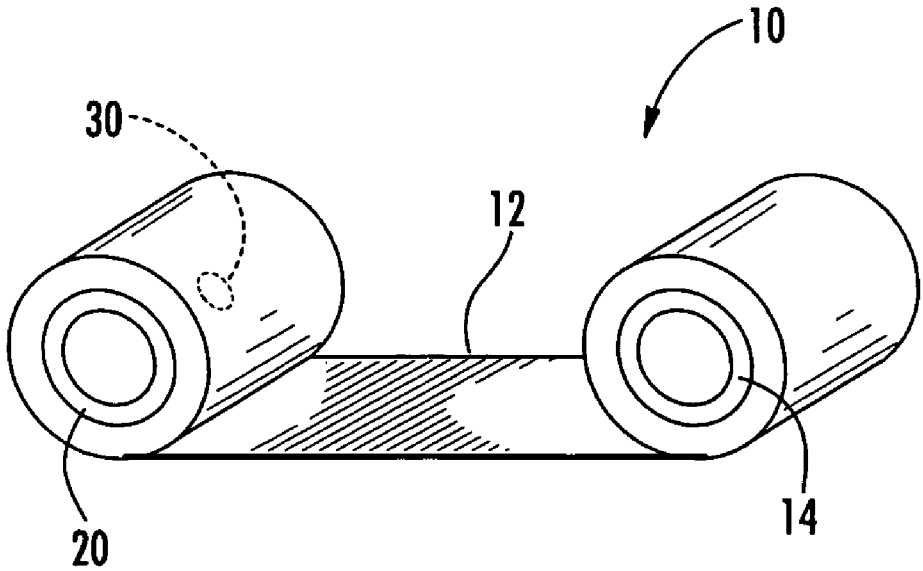
FIG. 7B is a perspective view of the media supply apparatus of FIG. 7A shown with the apparatus in a partially wound configuration.
Figure 8:
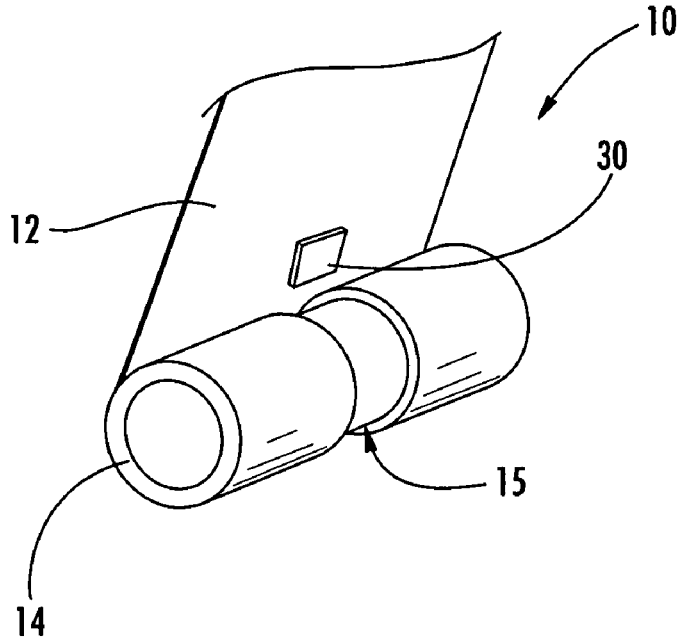
FIG. 8 is a perspective view illustrating a media supply apparatus according to another embodiment in which the spool defines an annular groove for at least partially receiving the wireless device.

FIGS. 6A–6B and 7A–7B illustrate embodiments in which the thickness of the wireless device is compensated for so as to ensure that the media properly winds about the spools. For example, as shown in FIGS. 6A and 6B, the wireless device 30 is disposed at the end 16 of the media 12 proximate to the spool 14, and the spool 14 defines a recess or detent 15 configured to at least partially receive the wireless device 30 when the media 12 is wound onto the spool 14. Alternatively, as shown in FIG. 7A and 7B, the wireless device 30 can be disposed at the opposite end 18 of the media 12 proximate to the take-up spool 20, and the take-up spool 20 can define the detent 15 so that the take-up spool 20 at least partially receives the wireless device 30 as the media 12 is wound thereon. In either case, the detent 15 can have a size that corresponds to the size of the wireless device 30 as illustrated, or the detent 15 can be larger than the wireless device 30. For example, as shown in FIG. 8, the recess 15 is a groove that extends annularly around the spool 14 so that the wireless device 30 can be disposed at least partially into the recess 15 regardless of the circumferential position of the wireless device 30 on the spool 14. As shown in FIG. 9, the read/write head 40 can be disposed within the spool 14 and configured to communicate with the wireless device 30 through the spool 14.

Figure 10:
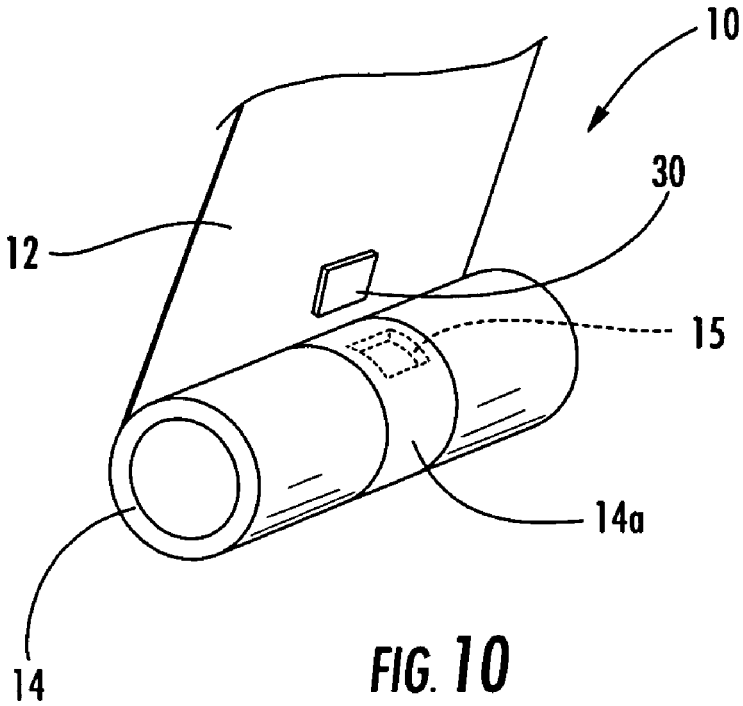
FIG. 10 is a perspective view illustrating a media supply apparatus according to another embodiment in which the spool defines a deformable material for at least partially receiving the wireless device.

In other embodiments, instead of having a pre-formed detent, groove, or other recess, the spool may be formed of a collapsible or deformable material that depresses when the wireless device comes in contact therewith to create the recess or detent. For example, as shown in FIG. 10, a central portion 14*a* of the spool 14 can be formed of a deformable material such as foam so that as the media 12 is wound onto the spool 14, the foam deforms to form the recess 15 (the position of the recess 15 being shown in dashed lines in FIG. 10) for at least partially receiving the wireless device 30.

Figure 11:
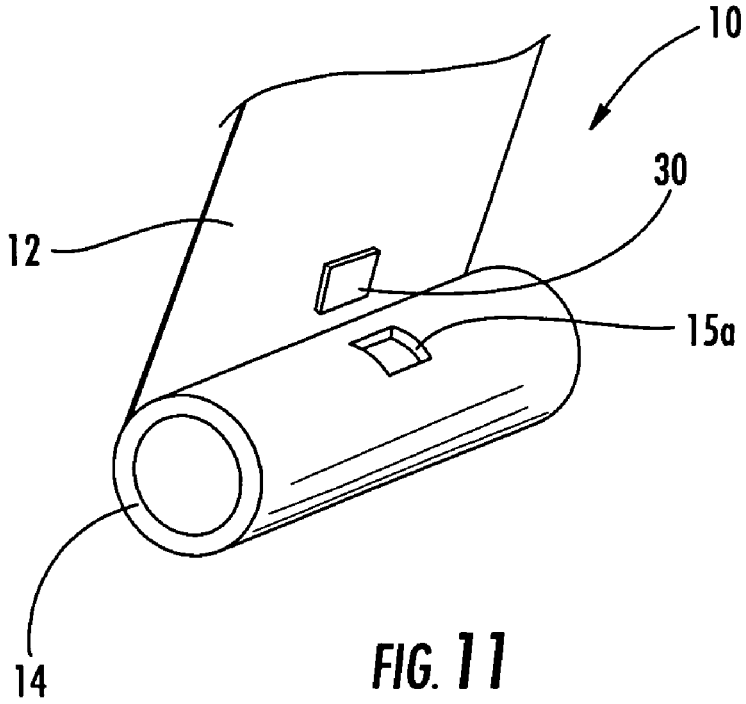
FIG. 11 is a perspective view illustrating a media supply apparatus according to another embodiment in which the spool defines an aperture through which the head and wireless device can communicate.

As shown in FIG. 11, the spool 14 can additionally, or alternatively, define an aperture 15*a* extending through the spool 14 from an outer surface of the spool 14 to a bore therethrough. The wireless device 30 can be disposed proximate to the aperture 15*a*. Thus, the read/write head 40 can be positioned in the bore of the spool 14 as shown in FIG. 9, and the read/write head 40 can communicate with the wireless device 30 through the aperture 15*a* so that the communication therebetween is not impaired by material of the spool 14 that would otherwise be between the read/write head 40 and wireless device 30.

In the embodiment of FIG. 1, the media 12 is a web of transfer ribbon or carrier such as is used for printing laminated PVC cards. The media 12 of ribbon can define repeating frames 26 of colored panels 28. For example, each frame of one typical ribbon includes five panels of different colored dyes. As is known in the art of thermal dye printing, a thermal dye printer can dispose the ribbon between a thermal print head and a substrate on which a design is to be printed. By locally heating portions of the thermal print head, the printer can transfer the dyes from the ribbon to the substrate. Thereafter, the ribbon can be advanced so that a new panel can be used to print on another substrate or another portion of the same substrate. In other embodiments of the present invention, the transfer ribbon or other print carrier can be used to dispose other print agents onto the substrate including, but not limited to, dyes, resins, inks, varnishes, and the like, which can be any color including black, clear (such as in the case of a clear protective material), or other colors such as yellow, magenta, and cyan. Each transfer ribbon or carrier can be configured to dispose one or more types and/or colors of print agents.

The read/write head 40 can be part of a device in which the media 12 is to be used. For example, as described above, the media 12 can be a transfer ribbon for use in thermal dye printing. Accordingly, the supply apparatus 10 can be installed in a thermal dye printer that includes the read/write head 40. Alternatively, the read/write head 40 can be part of other devices such as a dispensing device for dispensing paper, plastics, films, and the like during manufacturing and processing operations. In any case, the read/write head 40 can be connected to a controller 42 such as a computer processor device so that data can be communicated from the controller 42 to the memory 36 and/or from the memory 36 to the controller 42.

Figure 12:
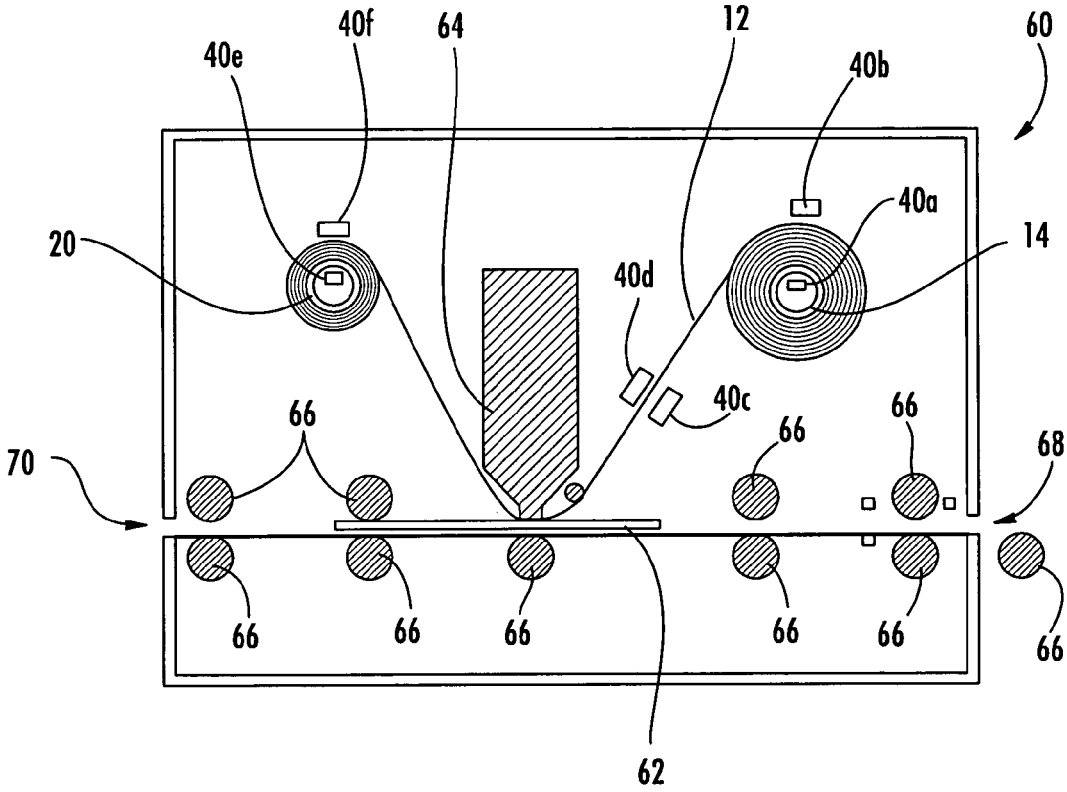
FIG. 12 is a section view illustrating a card printer for printing cards with a transfer ribbon according to one embodiment of the present invention.

FIG. 12 illustrates a card printer 60 that can be used with a transfer ribbon of one embodiment of the present invention for printing cards 62. The printer 60 includes a print head 64 that transfers dye or resin from the media 12 to one of the cards 62 as the cards 62 are transported through the printer 60 by rotatable rollers 66 from an entrance 68 to an exit 70 of the printer 60. The read/write head 40 can be provided at various alternative positions, indicated by reference numerals 40*a*–40*f*. Thus, depending on the position of the wireless device 30 on the media 12, the read/write head 40 can communicate with the device 30 as the device 30 rotates on one of the spools 14, 20, or as the device 30 is transported between the spools 14, 20. In addition, multiple read/write heads 40 can be provided at two or more of the various position 40*a*–40*f* or at other positions. For example, one of the read/write heads 40 can be provided at a first position to communicate with one of the wireless devices 30 proximate to the spool 14, such as at positions 40*a* or 40*b*. A second one of the read/write heads 40 can be provided at a second position to communicate with one of the wireless devices 30 proximate to the take-up spool 20, such as at positions 40*e* or 40*f*. Thus, the read/write heads 40 can selectively communicate with the multiple wireless devices 30 as described above in connection with FIG. 5A. Alternatively, the multiple read/write heads 40 can communicate with a single wireless device 30 as the position or orientation of the device 30 changes during loading, unloading, or operation of the device 30.

The data stored in the memory 36 of the wireless device 30 can include information associated with the type of the web 12, manufacturing aspects of the media 12 or supply 10, and the like. For example, in the case of a supply apparatus that provides a transfer ribbon or other carrier, the memory 36 can be programmed with values corresponding to the number of frames 26 or length of the media 12, the remaining (unused) length or remaining number of frames 26 on the media 12, the size and configuration of the frames 26, the color(s) of print agent(s) on the media 12, the average or particular print agent densities for frames 26 or panels 28 on the media 12, the location of defective frames 26 or panels 28 on the media 12, the date or location of manufacture of the media 12 or the supply apparatus 10, security or password information for restricting the use of the apparatus 10, and the like.

The data can be pre-programmed in the memory 36 before the use of the supply apparatus 10, e.g., during the manufacture of the supply apparatus 10. In this regard, the memory 36 can be programmed before or after the wireless device 30 is disposed on the media 12 and before or after the media 12 is wound onto the spool 14. In addition, the memory 36 can be programmed during use of the supply apparatus 10, i.e., by the read/write head 40. Communication can be performed by the read/write head 40 or another communication device, which can transmit a polling signal, such as an RF signal, to the wireless device 30 so that the device 30 communicates data stored in the memory 36 or so that the memory 36 is reprogrammed. The read/write head 40 can automatically retrieve data from the memory 36 when the apparatus 10 is installed in a device such as a printer, when the wireless device 30 rotates or otherwise moves to a particular position or into proximity with the read/write head 40, according to a predetermined schedule, upon an operator's request, or at other times during the manufacture, transport, use, or storage of the apparatus 10.

In the case where the memory 36 includes a counter for the remaining unused sets of frames in a supply apparatus for thermal printing, the counter can be decremented by the read/write head 40 each time the media 12 is advanced from the spool 14. The advancement of the media 12 can be detected, e.g., by optically monitoring the rotation of a wheel connected to the spool 14 or by detecting the passage of light through portions of the media 12. In other cases, the read/write head 40 can program the memory 36 to track other aspects of use such as the time of use, the device in which the supply apparatus 10 is used, the type of processing associated with the supply apparatus 10, and the like. For example, the wireless device 30 can be programmed with the start and end times of a process such as the exposure of the media 12 to heat or other radiation during manufacture or use. The data in the memory 36 can then be retrieved, e.g., by the read/write head 40, during use of the apparatus 10.

The wireless device 30 can be disposed on the media 12 during various stages of manufacture of the supply apparatus 10. In particular, the device 30 can be disposed on the media 12 prior to the winding of the media 12 onto the spool 14. For example, the device 30 can be disposed in conjunction with the manufacture of the media 12, i.e., while the media is being formed, cut, or otherwise processed. Thus, the orientation of the device 30 relative to the media 12 can be controlled. Further, the wireless device 30 can be disposed after the media 12 has satisfactorily progressed to a certain stage of manufacture, and/or the device 30 can be disposed after a particular quality of the media 12 and spool 14 has been verified. In some cases, the device 30 can be disposed on the media 12 after the media 12 has been wound onto the spool 14, e.g., after the supply apparatus 10 including the spool 14 and the media 12 has been satisfactorily manufactured and certain aspects of the quality of the supply apparatus 10 have been verified.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A media supply apparatus for maintaining a transfer ribbon comprising:

a spool;

a transfer ribbon defining first and second distal ends and being at least partially wound on the spool; and a wireless device disposed on said transfer ribbon, said wireless device having a memory configured to store data and an antenna configured to at least transmit the data stored in the memory to a remote location, wherein said transfer ribbon is wound on the spool such that the first end is disposed radially inward of a plurality of wound layers of said transfer ribbon and the second end is disposed radially outward of the plurality of wound layers of said transfer ribbon, said wireless device being disposed on said transfer ribbon proximate to the first end and in contact with the spool such that said wireless device is disposed between the spool and the plurality of wound layers of said transfer ribbon.

2. An apparatus according to claim 1 wherein said transfer ribbon is a dye carrier with at least one thermal transfer dye disposed thereon.

3. An apparatus according to claim 1 wherein said wireless device is programmed with data corresponding to a characteristic of said transfer ribbon.

4. An apparatus according to claim 1 further comprising a housing defining an interior space, the spool being disposed in the interior space of the housing and said wireless device being configured to receive a wireless signal transmitted through said housing.

5. An apparatus according to claim 1, wherein said wireless device is selected from the group consisting of RFID, optical, capacitive sense element, and magnetic sense element.

6. An apparatus for supplying a transfer ribbon, the apparatus comprising:

a spool;

a media of a transfer ribbon, said media defining first and second distal ends said media at least partially wound on the spool; and a first wireless device disposed on said media, said wireless device having a memory configured to store data and an antenna configured to receive a radio frequency signal for programming the memory;

wherein said spool defines at least one of the group consisting of an outer surface defining a recess for at least partially receiving the wireless device, an outer surface defining an annular groove for at least partially receiving the wireless device, an aperture extending from an outer surface of said spool with said wireless device being configured on said spool to communicate through the aperture, and a portion of the spool configured to be deformed such that said spool at least partially receives said wireless device.

7. An apparatus according to claim 6 wherein an outer surface of said spool defines a recess for at least partially receiving the wireless device.

8. An apparatus according to claim 6 wherein an outer surface of said spool defines an annular groove for at least partially receiving the wireless device.

9. An apparatus according to claim 6 wherein said spool defines a bore extending at least partially therethrough and an aperture extending from an outer surface of said spool to the bore, said wireless device being configured on said spool such that said wireless device can communicate through the aperture.

10. An apparatus according to claim 6 wherein a portion of the spool is configured to be deformed such that said spool at least partially receives said wireless device.

11. An apparatus according to claim 6 further comprising a housing defining an interior space, said spool being disposed in the interior space of said housing and said wireless device being configured to receive a wireless signal transmitted through said housing.

12. An apparatus according to claim 6 further comprising a second wireless device mounted to said spool and having a memory configured to store data and an antenna configured to receive a radio frequency signal for programming the memory of said second wireless device.

13. An apparatus according to claim 6 wherein said media is disposed in a wound configuration such that the first end is disposed radially inward of a plurality of wound layers of said media and the second end is disposed radially outward of the plurality of wound layers of said media, said wireless device being disposed on said media proximate to the first end.

14. An apparatus according to claim 6 wherein said media is disposed in a wound configuration such that the first end is disposed radially inward of a plurality of wound layers of said media and the second end is disposed radially outward of the plurality of wound layers of said media, said wireless device being disposed on said media proximate to the second end.

15. An apparatus according to claim 6 further comprising a structure and first and second spools rotatably mounted to said structure, said media being at least partially wound on said first spool and configured to be transferred therefrom to said second spool.

16. An apparatus according to claim 6 wherein said wireless device is programmed with data corresponding to a characteristic of said media.

17. An apparatus according to claim 6 further comprising an overlay adhered to said media with said wireless device disposed between said overlay and said media, wherein said overlay is a label with indicia thereon.

18. An apparatus according to claim 6, wherein said media includes multiple plies and said wireless device is located between two of the plies of said media.

19. An apparatus according to claim 6 wherein said wireless device is a radio frequency identification device configured to receive data via a radio frequency signal.

20. An apparatus according to claim 6, wherein said wireless device is selected from the group consisting of RFID, optical, capacitive sense element, and magnetic sense element.

21. An apparatus according to claim 6 further comprising a second wireless device, said wireless device having a memory configured to store data and an antenna configured to receive a radio frequency signal for programming the memory.

22. An apparatus according to claim 21 wherein said first and second wireless devices are configured to receive radio frequency signals from transceivers at different locations.

23. An apparatus according to claim 21 wherein said first and second wireless devices are configured to store different data.

* * * * *